US005822935A

United States Patent [19]

Mitchell et al.

[11] Patent Number: 5,822,935

[45] Date of Patent: Oct. 20, 1998

[54] SOLID-CORE WALL SYSTEM

[75] Inventors: Terry Mitchell; James D. Houda, both of Grand Rapids; Gary S. Juhlin, Alto, all of Mich.

[73] Assignee: Steelcase Inc., Grand Rapids, Mich.

[21] Appl. No.: 770,132

[22] Filed: Dec. 19, 1996

[51] Int. Cl.[6] ..... E04B 2/74; E04B 2/82

[52] U.S. Cl. ..... 52/239; 52/220.7; 52/241; 52/475.1; 52/481.2; 52/797.1; 52/801.11; 52/731.5; 52/731.9

[58] Field of Search ..... 52/483.1, 489.1, 52/489.2, 781.3, 797.1, 796.1, 800.1, 801.1, 801.11, 238.1, 239, 506.09, 475.1, 481.1, 481.2, 511, 764, 770, 771, 773, 775, 781, 241, 242, 243, 220.7, 733.2, 731.5, 731.9

[56] References Cited

U.S. PATENT DOCUMENTS

| | | | |
|---|---|---|---|
| 2,260,178 | 10/1941 | Guignon, Jr. . | |
| 2,815,542 | 12/1957 | Baker | 52/238.1 |
| 2,884,779 | 5/1959 | Buergin et al. | 52/241 X |
| 3,017,672 | 1/1962 | Vaughan | 52/800.1 X |

(List continued on next page.)

FOREIGN PATENT DOCUMENTS

| | | | |
|---|---|---|---|
| 1015919 | 8/1977 | Canada | 52/241 |
| 816627 | 8/1937 | France | 52/481.1 |
| 1467796 | 1/1967 | France | 52/242 |

OTHER PUBLICATIONS

Exhibit A discloses a prior art wall covering system for covering existing building walls, installed by Steelcase Inc., the present assignee.

*Primary Examiner*—Christopher Kent
*Assistant Examiner*—Laura A. Callo
*Attorney, Agent, or Firm*—Price,Heneveld,Cooper, DeWitt & Litton

[57] ABSTRACT

A reconfigurable wall system includes a solid-core wall which is comprised of a plurality of solid-core wall panels arranged in two adjacently abutting vertical layers. Each of the adjacently abutting layers of the solid-core wall comprises a plurality of solid-core panels arranged in edge-to-edge abutment. The abutting edges form vertical seams. The vertical seams in each of the layers of the solid-core wall are laterally offset from the seams in the adjacent layer to eliminate gaps through which light and sound can penetrate or leak. A plurality of vertical studs are disposed on opposite faces of the solid-core panel. Each of the studs is aligned with a stud on the opposite face of the solid-core wall, and a plurality of horizontally spaced apart fasteners extend through the solid-core wall and connect the aligned studs on opposite sides of the solid-core wall. A plurality of wall covering panels are mounted on the vertical studs. The reconfigurable wall system provides improved fire resistance and acoustical resistance and allows flexibility in the selection and replacement of wall covering panels.

26 Claims, 10 Drawing Sheets

U.S. PATENT DOCUMENTS

| | | | |
|---|---|---|---|
| 3,066,770 | 12/1962 | Millard et al. | 52/781 X |
| 3,255,563 | 6/1966 | Sauer | 52/770 X |
| 3,449,877 | 6/1969 | Beckman . | |
| 3,462,892 | 8/1969 | Meyer . | |
| 3,570,199 | 3/1971 | Gartner | 52/238.1 X |
| 3,733,756 | 5/1973 | Butler . | |
| 3,848,364 | 11/1974 | Costruba . | |
| 3,998,018 | 12/1976 | Hodges | 52/481.2 |
| 4,120,124 | 10/1978 | Temple et al. . | |
| 4,229,918 | 10/1980 | Delcroix | 52/242 |
| 4,251,968 | 2/1981 | Raith et al. . | |
| 4,306,396 | 12/1981 | Iotti | 52/238.1 |
| 4,356,672 | 11/1982 | Beckman et al. . | |
| 4,361,994 | 12/1982 | Carver | 52/241 X |
| 4,375,010 | 2/1983 | Mollenkopf . | |
| 4,438,614 | 3/1984 | Raith et al. . | |
| 4,478,018 | 10/1984 | Holand | 52/241 X |
| 4,535,577 | 8/1985 | Tenser et al. . | |
| 4,559,410 | 12/1985 | Hostetter . | |
| 4,581,859 | 4/1986 | Doke et al. . | |
| 4,610,118 | 9/1986 | Fullenkamp . | |
| 4,631,881 | 12/1986 | Charman . | |
| 4,757,657 | 7/1988 | Mitchell et al. . | |
| 4,841,699 | 6/1989 | Wilson et al. . | |
| 4,862,659 | 9/1989 | Wilson et al. . | |
| 4,881,352 | 11/1989 | Glockenstein . | |
| 4,944,122 | 7/1990 | Wendt . | |
| 5,038,539 | 8/1991 | Kelley et al. . | |
| 5,056,285 | 10/1991 | Frascaroli et al. . | |
| 5,062,246 | 11/1991 | Sykes . | |
| 5,065,556 | 11/1991 | DeLong et al. . | |
| 5,081,808 | 1/1992 | Bastian et al. . | |
| 5,154,030 | 10/1992 | Harms . | |
| 5,159,793 | 11/1992 | Deugo et al. . | |
| 5,172,530 | 12/1992 | Fishel et al. . | |
| 5,214,889 | 6/1993 | Nienhuis et al. . | |
| 5,214,890 | 6/1993 | Levitan et al. . | |
| 5,277,005 | 1/1994 | Hellwig et al. . | |
| 5,277,006 | 1/1994 | Ruster . | |
| 5,287,675 | 2/1994 | McGee . | |
| 5,305,567 | 4/1994 | Wittler . | |
| 5,309,686 | 5/1994 | Underwood et al. . | |
| 5,357,055 | 10/1994 | Sireci . | |
| 5,362,923 | 11/1994 | Newhouse et al. . | |
| 5,377,466 | 1/1995 | Insalaco et al. . | |
| 5,406,760 | 4/1995 | Edwards . | |
| 5,433,046 | 7/1995 | MacQuarrie et al. . | |
| 5,546,718 | 8/1996 | Way | 52/238.1 |

SOLID-CORE WALL SYSTEM

FIELD OF THE INVENTION

This invention relates to full height, demountable and reconfigurable wall systems, and in particular to reconfigurable, full height wall systems having utility distribution capabilities, improved acoustic resistance, and improved fire resistance.

BACKGROUND OF THE INVENTION

Wall panel systems for interior construction in buildings are well known. However, conventional interior wall panel systems are generally comprised of a plurality of interconnected hollow core partition panels, which in many cases do not provide adequate acoustical resistance, and which provide less fire resistance than might be desired. Known wall panel systems which are comprised of solid-core panels, such as gypsum wall panels, are not interconnected in edge-to-edge relationship, but are instead connected to studs which are interposed between adjacent panels. The studs in these wall systems are generally hollow. Accordingly, while these known systems having solid-core wall panels provide improved acoustic resistance and possibly improved fire resistance with respect to more typical wall systems having hollow core partition panels, the hollow studs provide an acoustic gap having a lower acoustic resistance than the solid-core wall panels connected thereto, thus diminishing the benefits of the acoustic insulating properties of the solid-core wall panels. Therefore, because of the hollow studs, known wall systems incorporating solid-core wall panels do not achieve optimum utilization of the sound insulating properties of the solid-core panels. The hollow studs may also provide reduced fire resistance as compared with the solid-core wall panels attached thereto, thus acting as gaps which are susceptible to fire propagation in an otherwise relatively fire resistant wall.

Another disadvantage with known wall panel systems incorporating solid-core wall panels is that they do not facilitate selection of a variety of different wall coverings or skins which can be easily installed and dismounted and replaced with different wall coverings as desired. Instead, the known partition systems incorporating solid-core wall panels generally have gypsum outer panels or other surfaces which can be painted or provided with a desired wall covering, such as wallpaper, which must be recovered in a conventional manner if a different wall covering is desired.

A further disadvantage with known wall panel systems incorporating solid-core wall panels is that the do not provide means for facilitating utility modules, such as for supporting an electrical receptacle, means for facilitating mounting of furniture to the wall system, or means for facilitating connection of perpendicular walls (off-walls) off of the wall systems from generally any selected location along the wall system.

With respect to particular known wall systems, U.S. Pat. No. 4,356,672 to Beckman discloses a partition system including gypsum sheets that can be covered with paneling, wallpaper, paint or other materials. However, Beckman does not disclose a solid-core wall, but instead discloses a wall having an internal space therein. U.S. Pat. No. 5,287,675 to McGee discloses a wall stud assembly including a solid wall interconnected by studs located between the solid wall sections. The solid wall sections extend between a ceiling channel and a floor channel. The studs between adjacent solid wall sections is generally hollow, thus providing an acoustical gap which may also be more susceptible to fire propagation than the panels connected thereto. Also, the solid-core panels disclosed by McGee are not comprised of solid gypsum, but instead are comprised of a honeycomb core with vinyl covered hardboard on each side, or a non-combustible insulating core such as polystyrene foam with gypsum panels laminated to outer sides thereof. U.S. Pat. No. 4,881,352 to Glockstiein discloses a wall having gypsum panels secured to opposing sides of a centrally located metal stud. The wall disclosed by Glockstiein is filled with a material which provides thermal and acoustic insulating properties. U.S. Pat. No. 3,462,892 discloses an adaptor wall having utility modules supported in the wall, but the wall is hollow and does not include a solid-core.

Accordingly, it is an object of this invention to provide a full height, demountable and reconfigurable wall system having a solid-core comprised of overlapping solid wall panels which provide improved acoustic and fire resistance properties. It is a further object of this invention to provide a reconfigurable solid-core wall system with improved acoustic and fire resistance properties which facilitates utility distribution. Another object of this invention is to provide a reconfigurable solid-core wall system having wall sections with either a glass transom, a solid-core transom or both. A still further object of this invention is to provide a reconfigurable, full height wall system wherein the main components of the wall system are a commodity item which can be purchased locally and which can be utilized without any substantial modifications. More particularly, it is an object of this invention to provide a full height, demountable and reconfigurable solid-core wall system comprising components which can be utilized with commodity dry wall panels to form a reconfigurable solid-core wall having improved fire and acoustic resistance.

SUMMARY OF THE INVENTION

In accordance with this invention, a demountable and reconfigurable wall system includes a solid-core wall including a plurality of solid-core wall panels which are arranged in abutting layers with a face of a solid-core wall panel in one wall layer abutting a face of a solid-core wall panel in an adjacent layer, and with side edges of the solid-core wall panels in each of the wall layers abutting a side edge of an adjacent wall panel in the same wall layer. The abutting edges of the adjacent panels in each of the wall layers form edge seams which are laterally spaced from the edge seams in an adjacent wall layer, whereby an opposing face of a panel in one layer overlaps the edge seam in the adjacent wall layer. The overlapping panels of the solid-core wall eliminate gaps at the joints of adjacent panels to eliminate light and sound leaks, and to provide improved fire resistance and acoustic resistance. A plurality of vertical studs are arranged in laterally spaced apart pairs with the members of each pair of studs aligned vertically on opposite sides of the solid-core wall. For each pair of vertical studs aligned on opposite sides of the solid-core wall, there is a provided a plurality of horizontally spaced apart fasteners which extend through the solid-core wall and which connect the studs on opposite sides of the solid-core wall. The vertical studs and fasteners apply compressive forces to the layers of the solid-core wall to structurally reinforce and strengthen the solid-core wall.

Relatively light weight wall coverings of skins are attached to the vertical studs to finish the wall. The skins can be provided with any of a variety of different wall covering materials on the outer exposed side thereof, including vinyl and fabric materials, to provide a desired aesthetic appearance.

In accordance with a preferred aspect of this invention, an expressway channel is attached to the solid-core to provide means for distributing utilities, such as electrical and communication cables, through the solid-core wall system.

The solid-core partition wall panels and wall systems provide better acoustic and fire resistance properties, are reconfigurable and reusable, can be configured for floor to ceiling privacy, and include releasably attached wall coverings or skins which allow greater flexibility in the selection of wall coverings and allow wall coverings to be changed more easily if desired. Because the wall systems are reconfigurable and reusable, rather than a permanent architectural feature of a building, they can have a lower life cycle cost than drywall construction which must be torn down and disposed of if reconfiguration of walls is required. Additionally, because the wall systems are reconfigurable and reusable, ownership can remain with a building tenant, so that the building tenant can disassemble the wall system and transport it and reuse it at a different location if desired. Also, because the wall system is portable, rather than a permanent architectural feature of a building, it can be depreciated over a shorter depreciation period. A further advantage is that the wall systems can be provided with power/data distribution capabilities, and can be easily modified or adapted to contain a utility module for supporting electrical receptacles or the like. The wall systems can also be provided with means for easily mounting furniture, off-walls, and the like.

DESCRIPTION OF THE PREFERRED EMBODIMENTS

Figure 1:
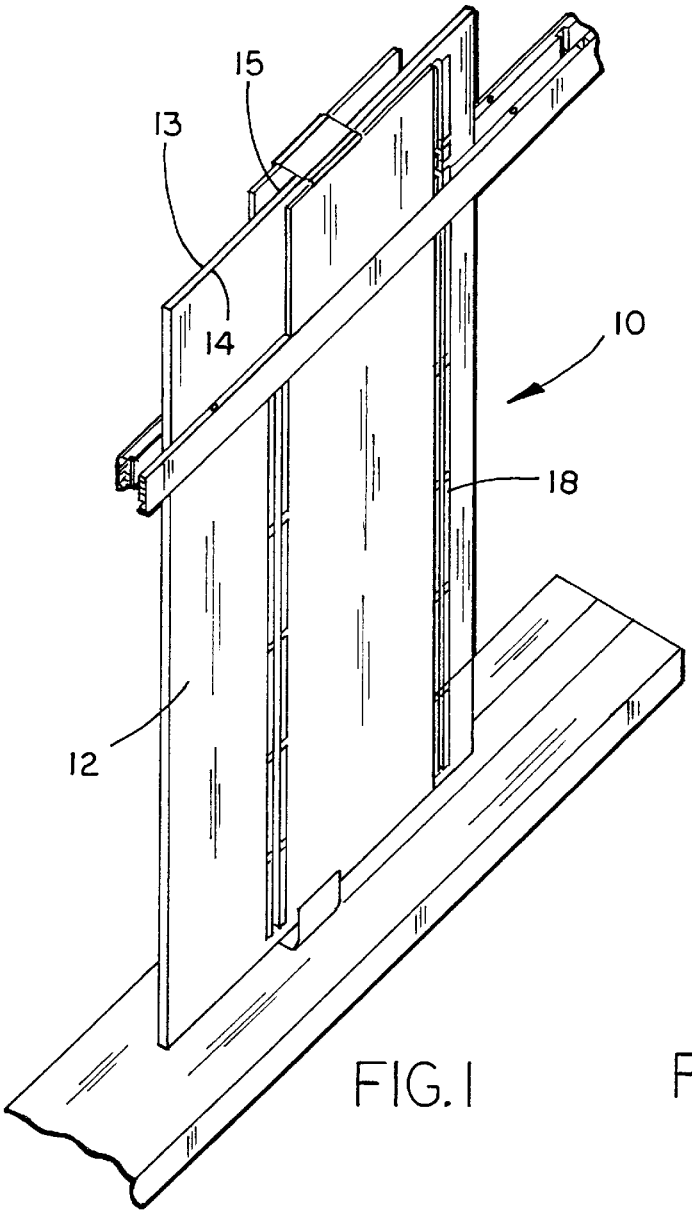
FIG. 1 is a perspective view of a portion of a solid-core wall system having an expressway channel, without wall covering skins attached to the portion of the studs below the expressway channel.
Figure 3:
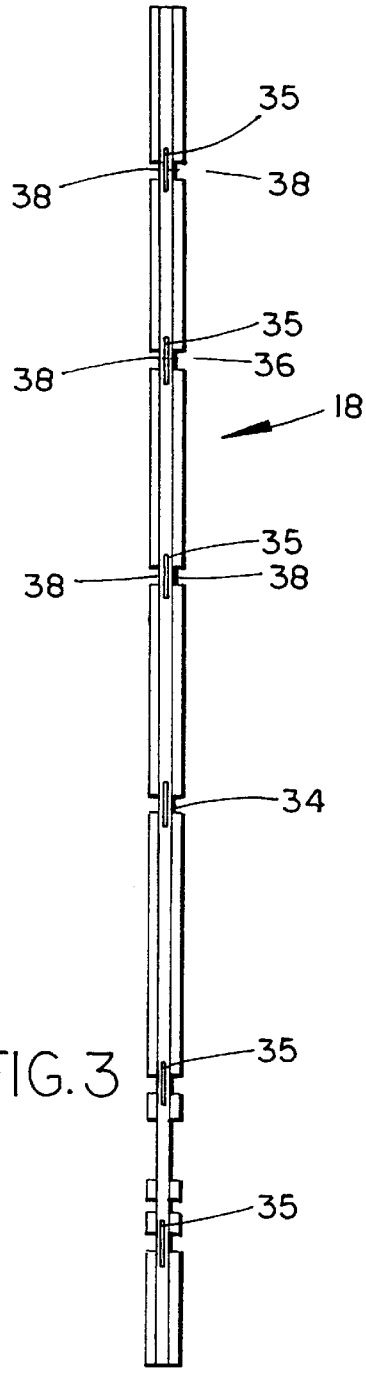
FIG. 3 is a side elevational view of a vertical stud used in constructing the solid-core wall system.
Figure 2:
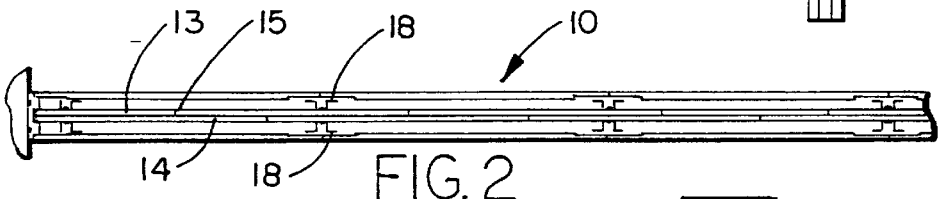
FIG. 2 is a horizontal cross sectional view of a solid-core wall system.

As shown in FIGS. 1 and 2, the solid-core wall system 10 is generally comprised of a plurality of solid-core partition panels 12 which are arranged in two adjacently abutting vertical layers 13, 14, with each layer comprising a plurality of solid-core panels arranged in edge-to-edge abutment to form joints of seams 15. The abutting edges or seams 15 are laterally offset from the seams in the adjacent layer so that the opposing face of a panel in one of the wall layers overlaps the joint in the adjacent wall layer. This overlapping arrangement of the seams and panels eliminates gaps in the wall through which light or sound could leak through, thus providing a continuous solid-core wall having improved sound, light and fire resistance, as compared with a wall system having only a single layer of solid-core panels arranged in edge-to-edge abutment. A plurality of laterally spaced apart reinforcing vertical studs 18 are disposed on the opposing sides of the solid-core wall comprising layers 13 and 14, with studs on opposite sides of the solid-core wall being arranged in vertically aligned pairs. A plurality of horizontally spaced apart fasteners (FIG. 5), comprising a flanged bolt 20 and a nut 22, extend through the solid-core wall and connect the vertically aligned studs on opposite sides of the solid-core wall. The fasteners and vertically studs apply compressive forces to the solid-core panels 12 comprising the abutting layers 13 and 14 to structurally reinforce and strengthen the core wall.

Figure 4:
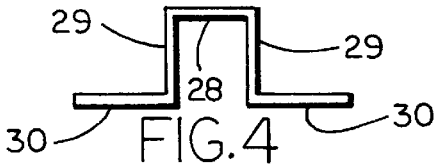
FIG. 4 is a transverse cross-section of the vertical stud viewed along lines IV—IV of FIG. 3.

The top edges of the solid-core panels 12 are positioned within a center channel 23 of ceiling track core capture extrusions 24 which are connected to a ceiling track 25 which can be secured to a ceiling or ceiling grid in a conventional manner. The bottom edges of the solid-core panels 12 are positioned within a center channel 26 of a floor track 27 which can be secured to a floor in a conventional manner. The vertical studs 18 generally have a capped-shaped transverse cross-section as shown in FIG. 4 which includes a base 28 which is abuttingly connected to the core wall, portions 29 which extend outwardly from the wall from opposite sides of the base and which together with the base define a channel like structure, and flanges 30 which extend away from each other in opposite directions from the outer edge of the outwardly extending portions 29. Near the upper end of the vertical stud 18, a section of the outwardly extending portion 29 and flanges 30 are cut out to allow an expressway channel 32 to be mounted to the core wall in the space between the outer face of the core wall and a vertical plane generally defined by the flanges 30. The base 28 of vertical stud 18 includes a circular aperture 34 which is located near the vertical center of the stud, and a plurality of vertically spaced apart elongate apertures or slots 35 through base 28 and located above and below the circular aperture 34. Flanged bolts 20 extend through the circular apertures 34 and slots 36 of studs 18 which are vertically aligned on opposite sides of the core wall, and nuts 22 are tightened onto the threaded end of the flanged bolts 20 to apply compressive forces to the solid-core panels 12 comprising the abutting layers 13 and 14 to structurally strengthen and reinforce the core wall. The circular aperture 34 is provided to anchor the studs 18 and to prevent vertical movement of the studs with respect to the panels 12. The elongate apertures or slots 36 allow a small amount of vertical adjustment of the studs 18 with respect to the panels 12 when the bolt 20 passing through apertures 34 of studs on opposite sides of the core wall is removed, and the nuts 22 on the remaining bolts passing through slots 36 are loosened. A small amount of vertical adjustment of the vertical studs 18 is desired to compensate for misalignment of the wall covering skins attached to the studs. Notches 38 are preferably cut out of studs 18 to remove sections of outwardly extending portions 29 and flange portion 30 on each side of aperture 34 and slots 36 to allow nuts 22 to be tightened onto bolts 20 with tools. The studs 18 are preferably formed of metal sheet material, with a preferred material being 18 gauge cold rolled steel. The studs can be made in generally any length, although it is anticipated that standard 7 foot, 9 foot, and 11 foot lengths will be most commonly employed.

Figure 5:
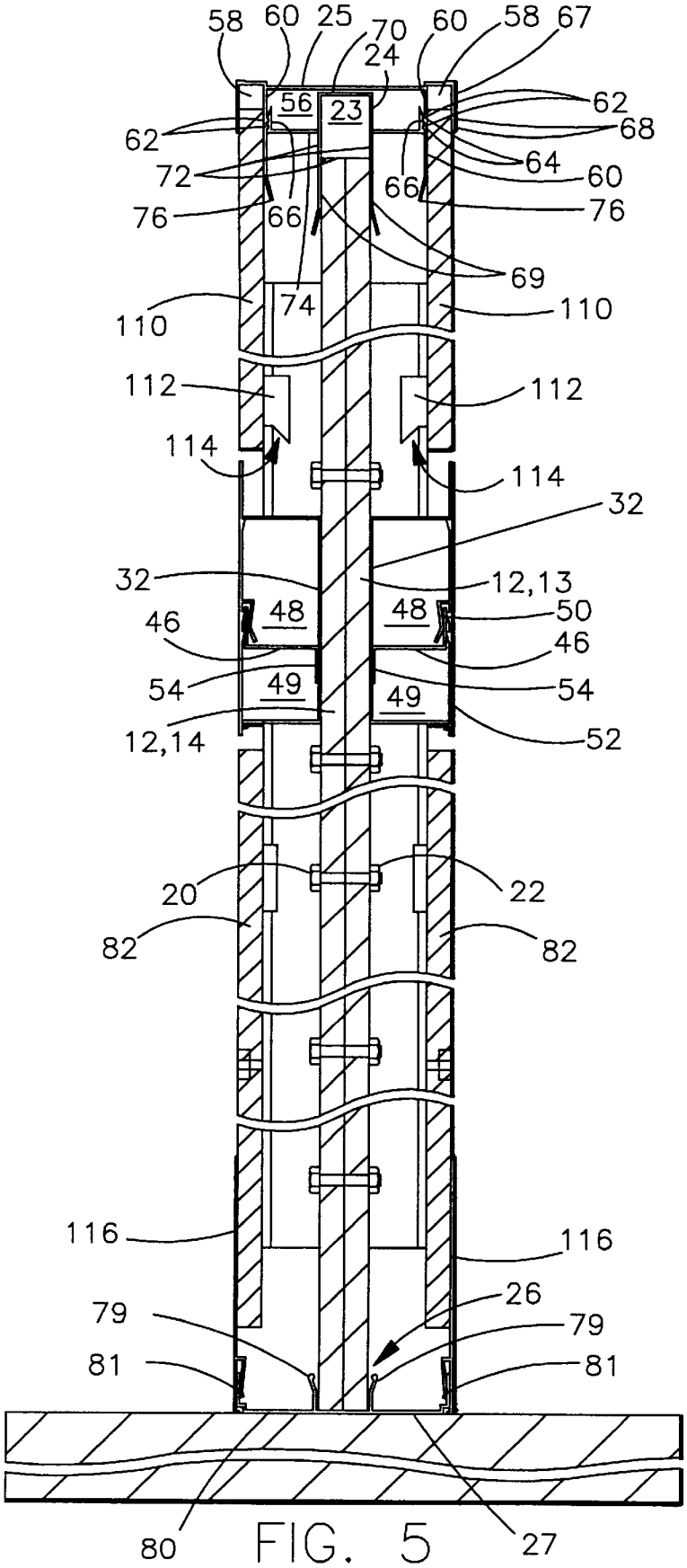
FIG. 5 is a vertical cross sectional view of a solid-core wall having an expressway channel and a solid-core transom above the expressway channel.

There is shown in FIG. 5 a typical vertical cross sectional view of a solid-core wall wherein the solid-core wall partition 12 extend from the floor to the ceiling track core capture extrusion 24 mounted to ceiling track 25 which is secured to a ceiling or a ceiling grid. The term "ceiling grid" as used herein refers generally to a network comprised of a plurality of regularly spaced apart runners or support members which extend in a first direction and a plurality of runners or support members which are regularly spaced apart and which extend in a direction perpendicular to the first direction. The ceiling grid provides structure from which ceiling panels, lighting panels, ventilation panels and the like can be supported to form a false or drop ceiling below a permanent architectural ceiling or roof. The reconfigurable wall shown in FIG. 5 includes a pair of expressway channels 32, each of which includes a shelf or center septum 46 which serves as a divider to separate the expressway channel into an upper channel 48 and a lower channel 49. The center septum also includes an upwardly extending wall portion 50 to help retain utility cables on the upper channel 48 and provides means for attaching the expressway cover 52 to the expressway channel 32. The expressway channel 32 is preferably made from metal sheet material, such as 20 gauge cold roll steel. The rear wall 40, bottom wall 42 and top wall 44 are preferably formed from a single strip of steel, and the center septum 46 is preferably formed from a separate strip of steel, and is formed to have a downwardly extending portion 54 which is welded to the rear wall 40 of expressway channel 32.

Ceiling track 25 includes a center channel 56 and side channel 58 which are located on opposite sides of the center channel 56. The vertical walls 60 which separate the center channel 56 from the side channels 58, each include a pair of vertically spaced apart ribs or ridges 62, which are located near the lower edges of the wall 60, on the sides of wall 60 which are facing toward the center channel 56. Rib 62 are provided to engage the valleys between vertically spaced apart ridges 64 on upwardly extending arms 66 of ceiling track core capture extrusion 24. The outer walls 67 of ceiling track 25 also each include a pair of vertically spaced apart ridges 68 which are located near the lower ends of wall 67 and face toward the side channels 58. The purpose of ridges 68 will be described subsequently. Ceiling track core capture extrusion 24 includes a center channel 23 for receiving the upper end of the solid-core wall comprising adjacently abutting layers 13 and 14, each comprised of a plurality of solid-core panels 12. Center channel 23, defined by vertical wall 69 and top wall 70, serves to grippingly engage the upper end of the solid-core wall and hold the core panels 12 in an upright position. To facilitate gripping of the core panels 12, vertical walls 69 are provided with a plurality of ridges or bumps 72. Projecting away from each of the vertical walls 69 of ceiling track core capture extrusion 24 and toward vertical walls 60 of ceiling track 25 are webs 74. At the end of each of the webs 74 is an upwardly projecting arm 66 having ridges 24 which engage ridges 62 of vertical walls 60, as described above. Extending downwardly from each of the ends of webs 74 are insertion/release tabs 76. The lower ends of insertion/release tabs 76 can be forced away from the center channel to cause webs 74 to flex, to permit disengagement of ridges 64 from between the ridges 62 of ceiling track 25 to allow the ceiling track core capture extrusion 24 to be attached to, or detached from, the ceiling track 25. Ceiling track 25 and ceiling track core capture extrusion 24 are preferably made of extruded aluminum, although it is conceivable that ceiling track core capture extrusion 24 and ceiling track 25 can be extruded, molded or otherwise formed from plastic materials or other materials. Ceiling track 25 preferably extends along the entire length above the solid-core wall system. The ceiling track 25 can be provided in any practical length which can be shipped to, and handled and transported at, the point at which it is used. It is anticipated that the ceiling track will be shipped in 12 foot long sections, although custom lengths can be provided. The core capture extrusion 24 can run continuously along the length above the wall system, if desired. However, the core capture extrusion 24 are preferably relatively short pieces, e.g., 6 inches long, which are spaced apart along a run of ceiling track. The core capture extrusion 24 are preferably about equally spaced apart, such as every 12 inches.

Floor track 27 includes a center channel 26 which is defined by a pair of walls 79 which extend upwardly from a base 80 of floor track 27. Center channel 78 of floor track 27 is sized and configured to receive the lower edge of the solid-core comprised of abutting core layers 13 and 14 and, together with the vertical walls 69 of ceiling track core capture extrusion 24, hold the solid-core of the wall system upright in a vertical plane. Floor track 27 also includes a pair of walls 81 which extend upwardly from the opposite lateral edges of base 80. Floor track 27 is preferably an aluminum extrusion, but other materials such as extruded or molded plastic materials can conceivably be used. Floor track 27 preferably extends along the entire length below the core wall of the wall system. The floor tracks are preferably provided in standard lengths, such as 12 foot lengths, but custom lengths are also possible.

Figure 9:
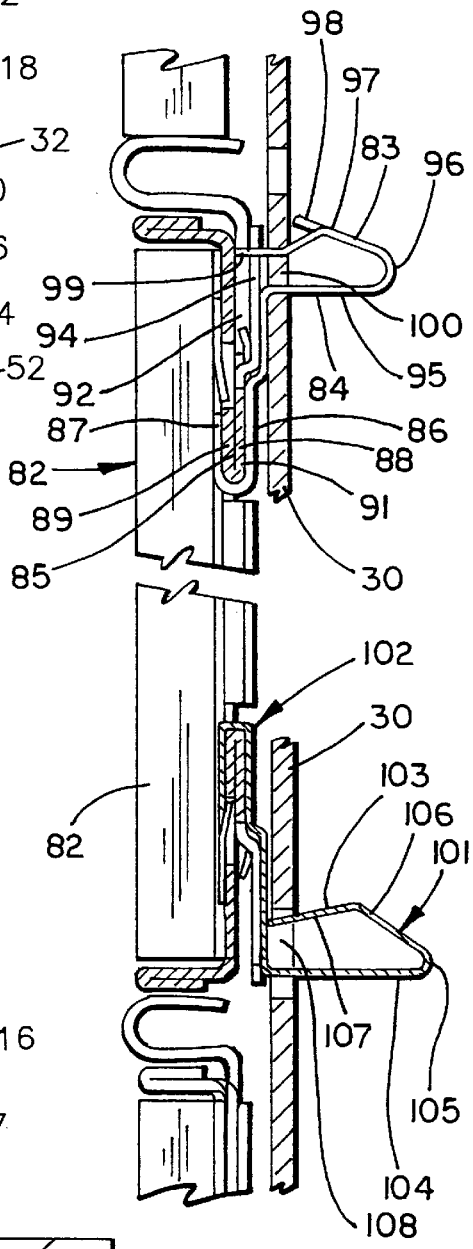
FIG. 9 is a side elevational view in partial cross-section showing the manner in which the wall cover panels are attached to the vertical studs.

Wall cover panels 82 can be attached to the vertical studs 18 in the manner generally shown in FIG. 9. Wall cover panel 82 includes a top connector clip 83 having a U-shaped stud-engaging upper section 84, a lower section 85 including opposing flanges 86 and 87 with a space therebetween for frictionally engaging flanges 88 and 89 on edging 91. Flange 87 is shaped to matably engage flange 89 of edging 91. A tooth 92 on flange 87 engages flange 89. Clip upper section 84 includes a flat horizontal bottom flange 95, a resilient end section 96, and a reversibly bent angled flange 97. An interlocking anti-dislodgement tooth (or teeth 98) extend from angled flange 97, tooth 98 being co-planar with angled flange 97. A release/disengagement tab 99 also extends from angled flange 97. The tab 99 extends at an angle below tooth 98. Tab 99 extends through a plane defined by vertical flange 94 to a location within the space between flanges 86 and 87. Tooth 98 does not extend through the plane defined by vertical flange 94, such that clip 83 can be inserted into a aperture 100 through flanges 30 of vertical stud 18.

A cover-panel-supporting bottom connector or clip 101 includes a U-shaped cover-panel-engaging upper section 102 that is an inverted mirror image of lower section 85 on clip 83. A stud-engaging lower section 103 extends from a bottom of upper section 102. Lower section 103 includes a flat horizontal bottom flange 104, a resilient end section 105, and a reversibly bent upwardly angled flange 106. A downwardly angled flange extension 10 extends from angled flange 106. The flange extension 107 frictionally engages an upper edge of an aperture or notch 108 in flange 30 of vertical stud 18.

Cover panel 82 can be attached to vertically spaced apart apertures 100 and 108 as shown in FIG. 9 by engaging top clips 83 until the anti-dislodgement teeth 98 engage flange 30. Then the lower clips 101 are snapped into engagement with aperture 108 in flange 30.

The solid-core panels 12 used in assembling or constructing the solid-core wall system can be selected from a variety of standard wall board products, including any of several structural boards or sheets of various materials, such as gypsum plaster encased in paper or compressed with fibers and chips. Examples of preferred materials include standard sheet rock or gypsum board and fiber reinforced gypsum panels. The fiber reinforced gypsum panels, such as those sold under the tradename "Fiberbond" and manufactured by Louisiana-Pacific, are preferred because they have higher STC value and are slightly stronger than gypsum board. Both gypsum board and fiber reinforced gypsum panels offer good fire resistance.

The skins or wall cover panels 82 is comprised of a relatively rigid and lightweight frame having at least one planar substrate surface over which a wall covering material, such as a vinyl wall covering or a fabric wall covering, is attached. An example of a preferred skin design comprises a steel frame with a 12 to 14 pound fiberglass board substrate which is covered with a wall covering material. The skins or wall covering panels can be generally any height, such as from a few inches above the floor to a short distance below the expressway channel 32, and of generally any length, limited by practical consideration such as ease of transporting and handling the panels. Generally, it is preferable that the panels be relatively short, such that a plurality of panels are required to cover the area of the core wall from above the floor to below the expressway channel, so that a seam or reveal is defined by the small space or gap between the upper edge of one panel 82 and the lower edge of an adjacent panel 82. Horizontally extending slotted tracks can be mounted to the core wall behind the seams or reveals to provide means for mounting furniture, such as binder binds, and the like to the wall system. The panels 82 below the expressway channel 32 are connected to apertures 100, 108 on flanges 30 of vertical studs 18, as described above.

Transom covering panels 110 are generally similar to panels 82 previously described, except that the method of attachment differs. Specifically, the upper edges of panels 110 are inserted into the side channels 58 of ceiling track 25 and a support tab 112 which projects rearwardly from the back side of panel 110 toward the solid-core wall is inserted into a notch 114 in flanges 30 of vertical stud 18.

Figure 7:
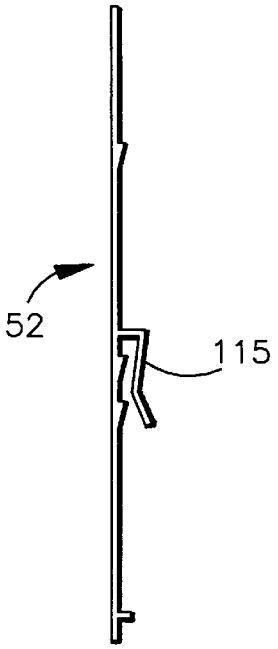
FIG. 7 is an enlarged side elevational view of the expressway cover.

Expressway cover 52 is formed of an extruded plastic material, preferably polyvinyl chloride. The expressway covers 52 are used to cover the opening or channels of the expressway channel 32. The expressway covers 52 extend along the entire length of the expressway channel and are typically shipped in standard 12 foot lengths. The expressway cover 52 includes a clip 115 (FIG. 7) which projects from the side of the expressway cover facing the channels 48 and 49 of expressway channel 32. Clip 115 is configured to attach to the upwardly extending wall portion 50 of center septum 46.

Figure 8:
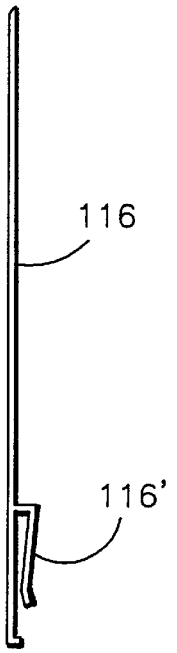
FIG. 8 is an enlarged side elevational view of the base molding for the solid-core wall.

To provide a neat, finished appearance, base trim moldings 116 (FIG. 8) are attached with a clip 116' to the upwardly extending outer walls 18 of floor track 27, and cover the gap between the lower edges of the wall cover panels 82 and the floor track 27. The base trim moldings 116 are preferably made of an extruded plastic material, most preferably polyvinyl chloride, and are preferably cut to standard lengths for shipment, such as 12 foot lengths.

Figure 6:
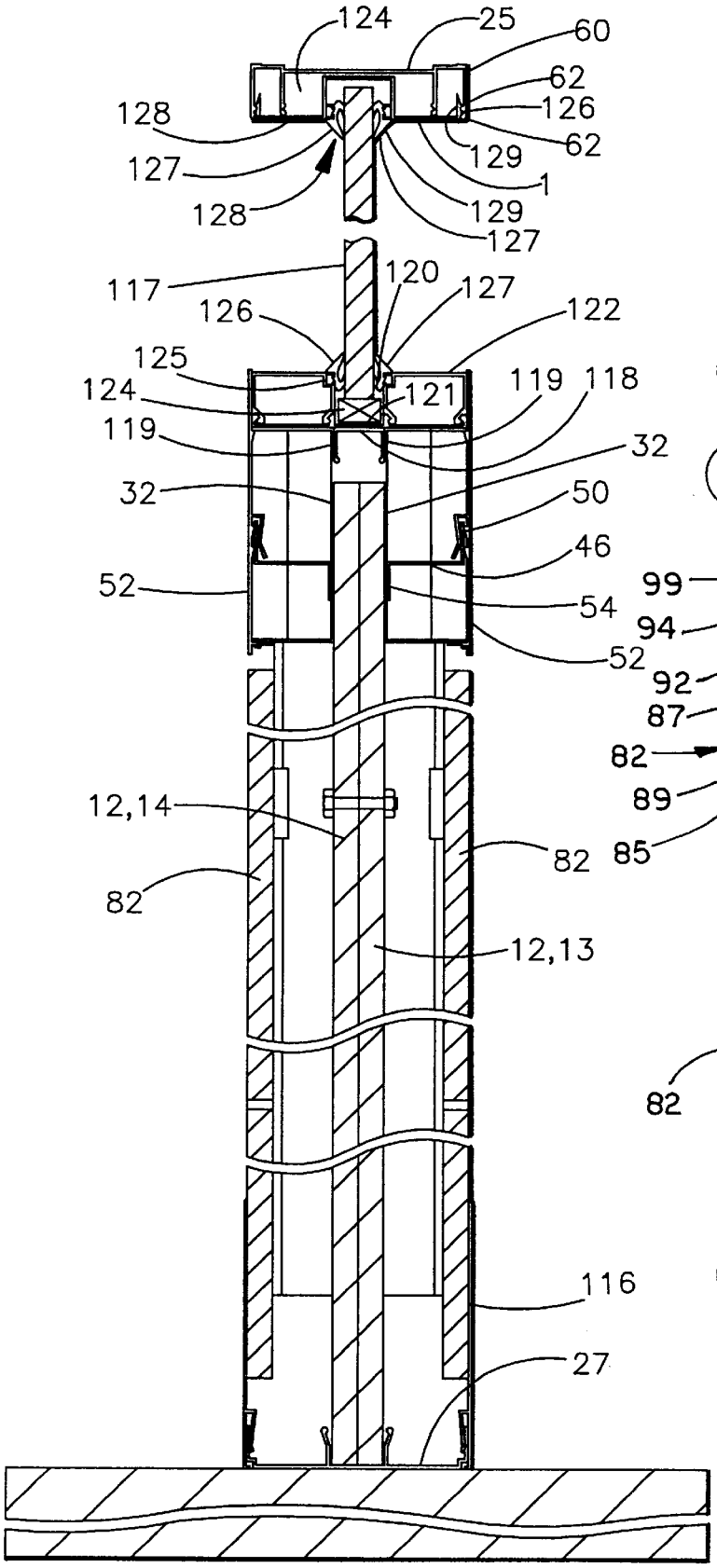
FIG. 6 is a vertical cross sectional view of a solid-core wall having an expressway channel, with a glass transom above the expressway channel.

In FIG. 6, there is shown a solid-core wall system, which is generally similar to the wall system shown in FIG. 5, but wherein the solid-core wall panels terminate at the expressway channel, and a glass transom completes the portion of the wall from the top of the expressway channel 32 to the ceiling track 25. As with the solid-core wall shown in FIG. 5, the solid-core wall in FIG. 6 has expressway channels 32 mounted to the opposing faces of the solid-core comprised of solid-core panels 12 and a specially configured expressway cap 118 having downwardly extending walls 119 which frictionally engage the oppositely facing rear walls of expressway channels 32, and have upwardly projecting connector hooks 120 which engage downwardly projecting connector hooks 121 of a specially configured glass capture extrusion 122. Glass capture extrusion 122 and expressway cap 118 together define an upwardly opening channel 123 for receiving the lower edges of glass transom 117. A transom support bead 124 is disposed in the bottom of channel 123 to support glass transom 117. Glass capture extrusion 122 also includes a pair of horizontally extending recesses or grooves 129 which are disposed on the opposite walls defining channel 123. Grooves 125 are configured for receiving and retaining connector portions of a stationary bead 126 and a roll-in bead 127. Beads 126 and 127 are elastomeric extrusions which apply compressive forces to opposite faces of glass transom 117 near the lower edge thereof to hold the glass transom in an upright position in channel 123. An upper glass capture extrusion 128 includes a downwardly opening channel 124 for receiving the upper end of glass transom 117. Upper glass capture extrusion 128 also includes, at opposing lateral edges thereof, upwardly projecting walls 125, each of which includes a horizontally extending ridge 126 which is configured to fit within the valley between ridges 62 of vertical walls 60 of ceiling track 25 to facilitate snap attachment of upper glass capture extrusion 128 to ceiling track 25. Channel 124 of extrusion 128 also includes a pair of horizontally extending recesses 127 which are configured to engage and retain connector portions of stationary bead 128 and roll-in bead 129. Beads 128 and 129 are preferably elastomeric extrusions which hold glass transom 117 in an upright position within channel 124.

Figure 10:
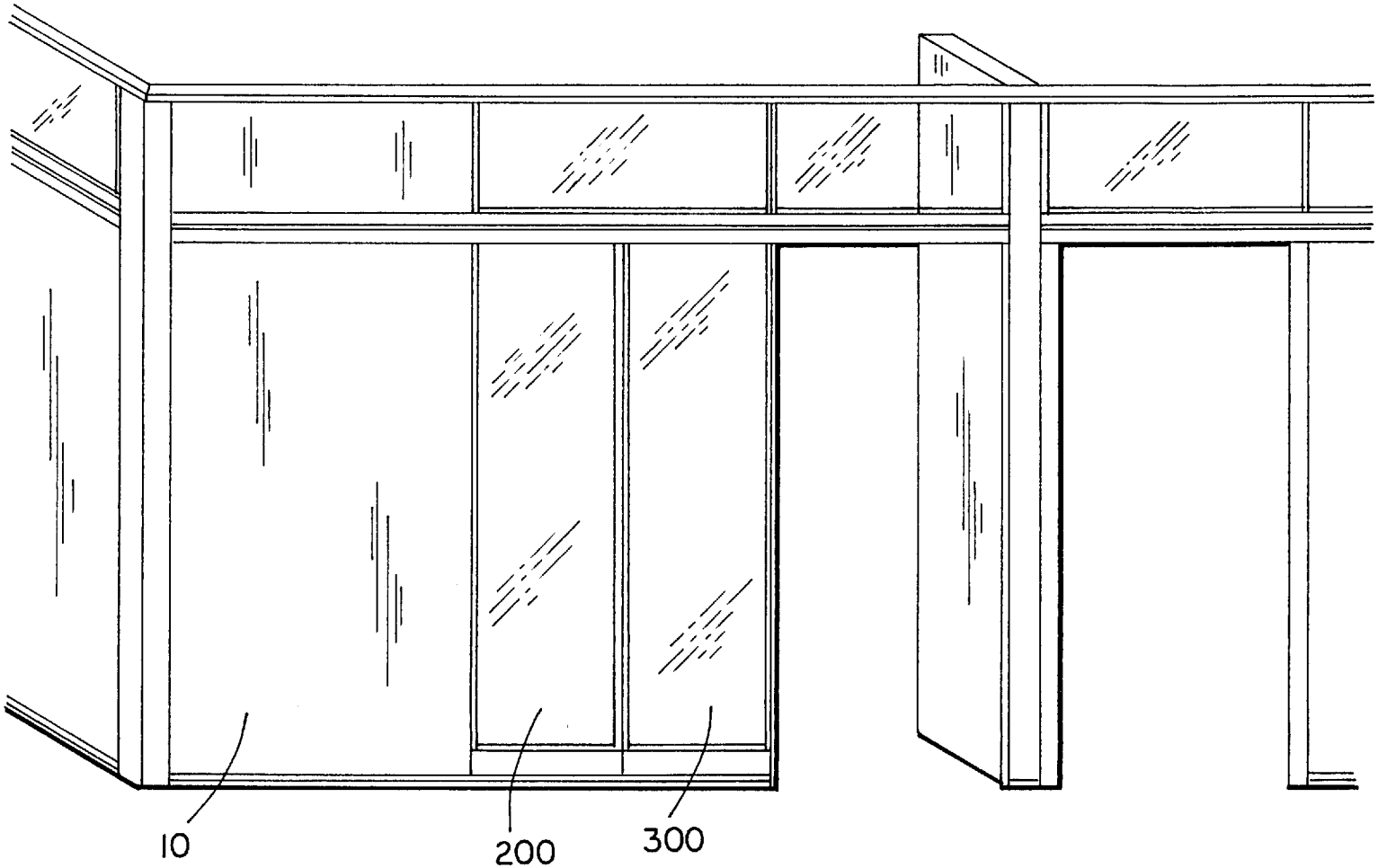
FIG. 10 is a perspective view of a typical application of the solid-core wall system.
Figure 11:
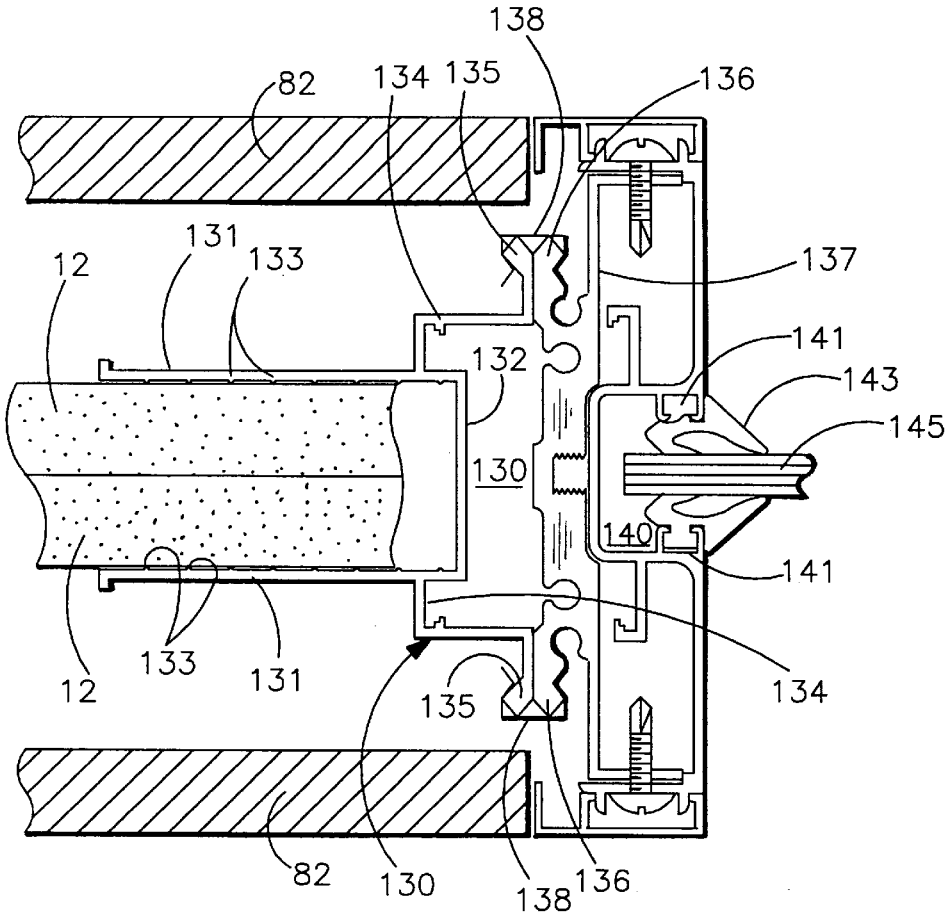
FIG. 11 is a horizontal cross-section of a solid-core wall to glass wall transition as viewed along lines XI—XI of FIG. 10.
Figure 12:
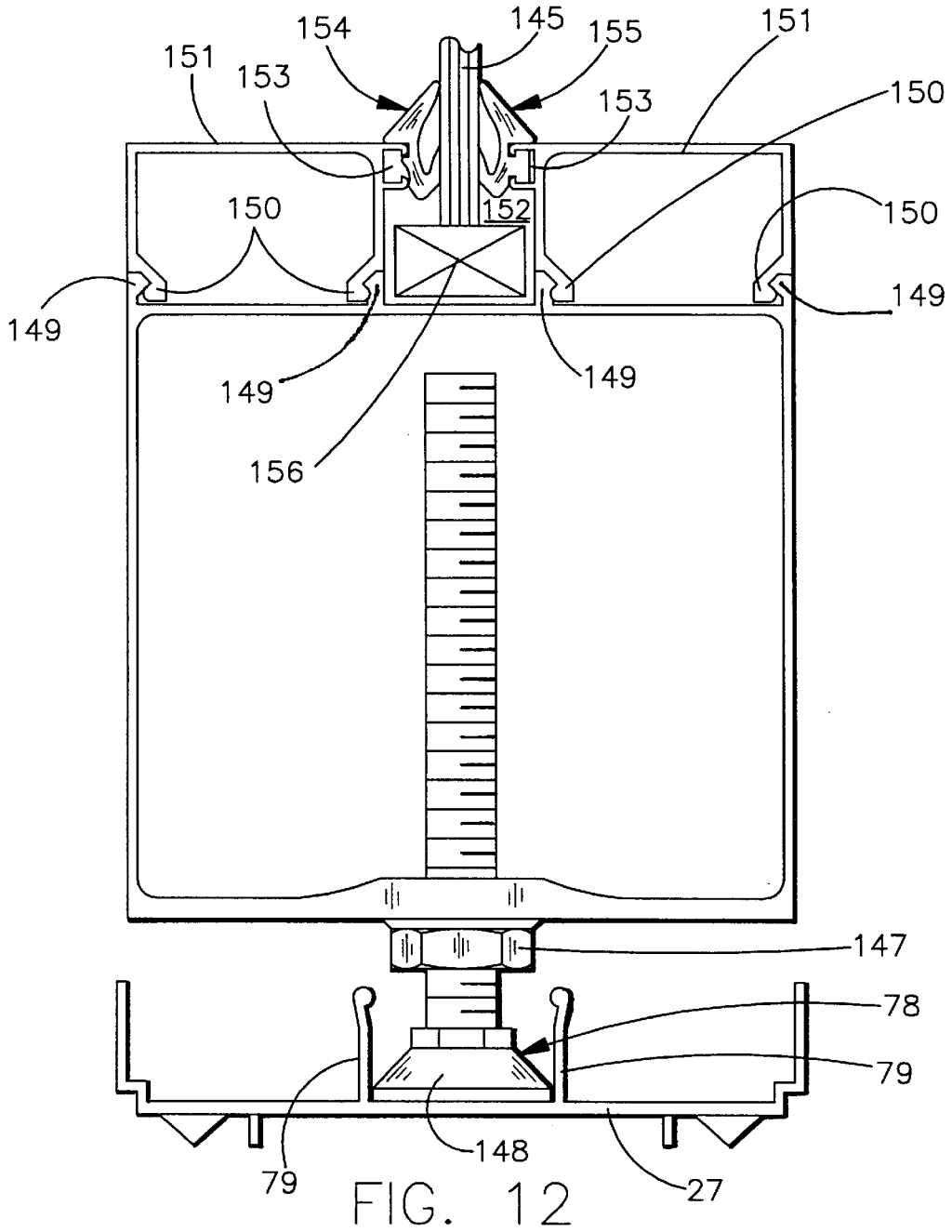
FIG. 12 is a vertical cross-section of the base assembly for the glass wall as viewed along lines XII—XII of FIG. 10.
Figure 13:
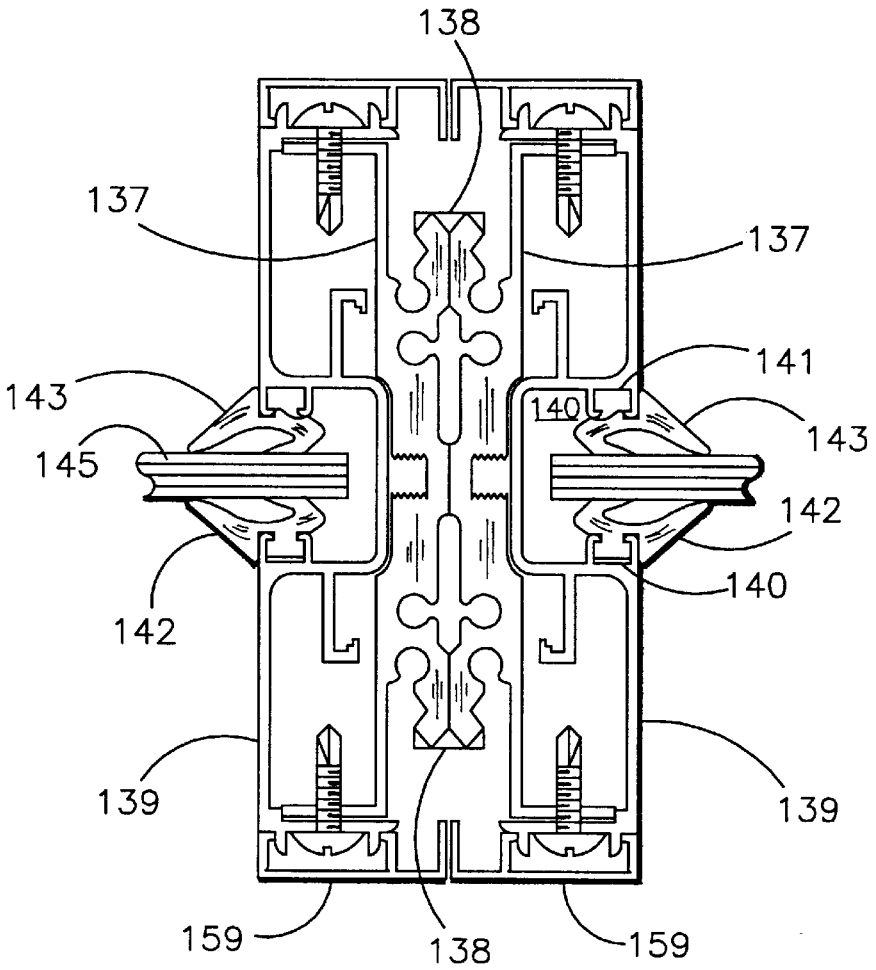
FIG. 13 is a horizontal cross-section of a glass wall to glass wall connection as viewed along lines XIII—XIII of FIG. 10.
Figure 14:
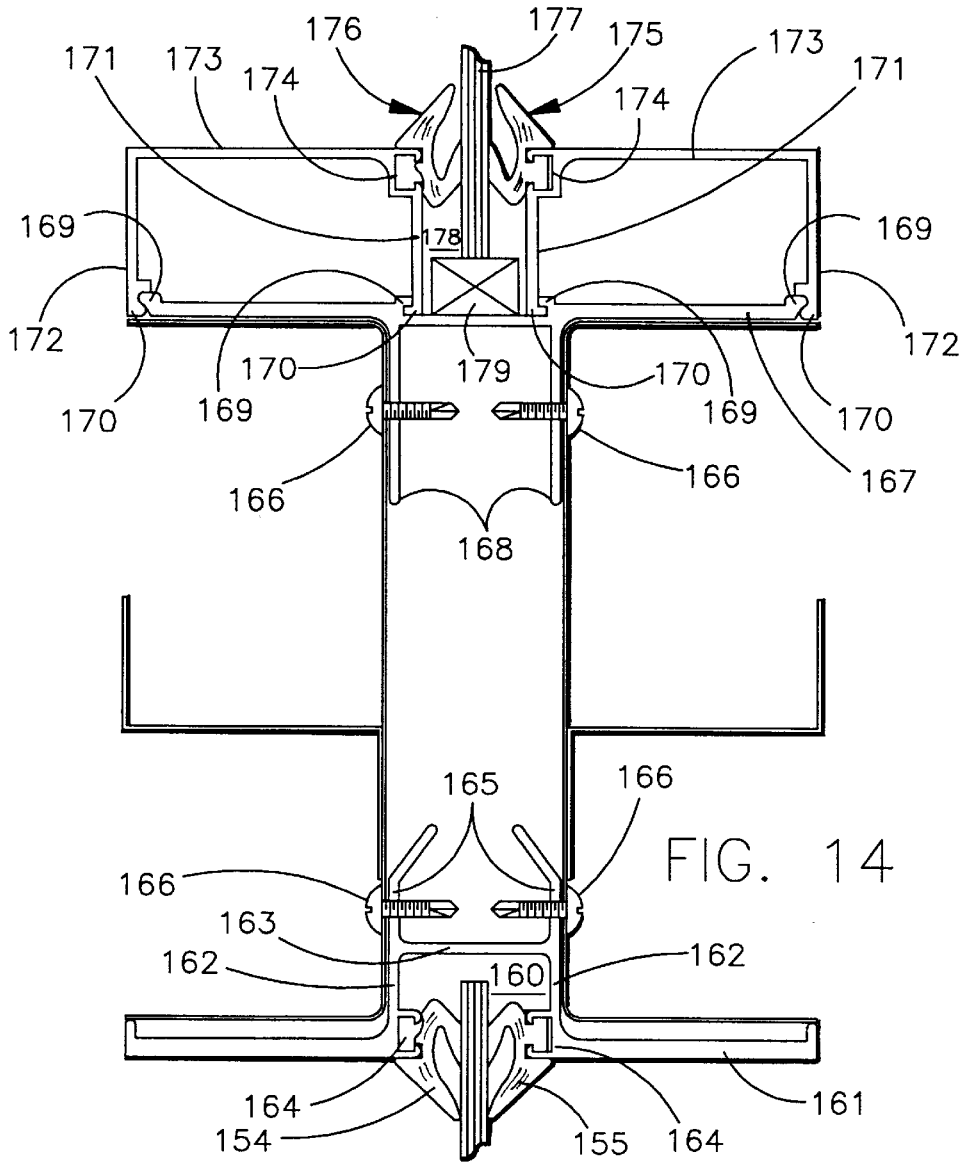
FIG. 14 is a fragmentary, vertical cross-section of an expressway mounted above a glass wall and having a glass transom above the expressway, as viewed along lines XIV—XIV of FIG. 10.

FIG. 10 illustrates how the solid-core wall interfaces with or is connected to glass walls 300. Referring to FIG. 11, connection between the solid-core wall and a glass wall is achieved through a plurality of extrusions and spring clips. An edge of a core wall comprising solid-core panels 12 which is to be connected to a glass wall is provided with a core cap extrusion 130 having a channel portion defined by oppositely facing walls 131 which project from a base wall 132. Each of the walls 131 frictionally engage the opposing faces of the core wall at an end thereof. The walls 131 preferably include a plurality of ribs or bumps 133 which enhance frictional engagement between the core wall and the core cap extrusion. Projecting from each side of the core cap extrusion are arms 134 having a connector portion 135 which seats against a connector portion 136 projecting from a connector extrusion 137. The connector portion 135 of core cap extrusion 130 and connector portions 136 of connector extrusion 137 are held together by a spring clip 138 which joins the core cap extrusion to the connector extrusion. The connector extrusion 137 is secured to a glass jam extrusion 139 defining a central channel 140, the side walls of which include vertically extending recesses or grooves 141 which are configured to receive connector portions of stationary bead 142 and roll-in bead 143 which hold a glass pane 145 in a vertical position within the channel 140. With reference to FIG. 12, glass panel 145 is supported by a glass base 146, which is a tubular extrusion having a rectangular cross sectional shape. Glass base 146 includes a leveling glide 147 which can be rotated to vertically adjust the height of the glass wall. Connected to the lower end of the leveling glide is a foot 148 which is sized and configured to fit within center channel 78 of floor track 27 and engage the walls 79 which define the center channel 78. Glass base 146 also includes a plurality of upwardly projecting connector hooks 149 which engage downwardly projecting hooks 150 of glass stops 151. Connector hooks 149 and 150 provide a snap together type of connection between glass stops 151 and glass base 146. Glass stops 151 and glass base 146 together define an upwardly opening channel 152 for receiving the lower edge of glass pane 145. Each of the glass stops 151 includes a horizontally extending groove 153. Grooves 153 are sized and configured to receive a connector portion of a roll-in bead 154 and a stationary bead 155. Beads 154 and 155 are preferably and extruded elastomeric material which resiliently engages and retains the opposing faces of glass pane 145 near the lower edge thereof to hold the glass pane upright within channel 152. A support bead 156 is disposed within channel 152 between the bottom thereof and between the lower edge of the glass pane 145. Support bead 156 is preferably an elastomeric extrusion which is capable of supporting glass pane 145 without abrading the lower edges thereof. The edge of glass pane 145 which is opposite of the edge connected to the solid-core wall (as shown in FIG. 11) is disposed within a channel 157 (FIG. 13) defined by a second glass jam extrusion 139, and is held in an upright position by a stationary bead 142 and a roll-in bead 143. Glass jam extrusion 139 is connected to a connector extrusion 137 which is in turn clipped to another connector extrusion 137 with spring clips 138. The second connector extrusion (the connector extrusion 137 on the right side in FIG. 13) is connected to a second glass jam extrusion 139 defining a channel 140 having grooves 141 which receive beads 142 and 143 to hold a second glass pane 158 upright. The connection between adjacent glass panes 145 and 158 is finished with a plurality of jam trim extrusions 159 which cover and conceal connector extrusions 137, spring clips 138, and the connection between the glass jam extrusions 139 and the connector extrusions 137. The upper edge of the glass pane 145 is held within a channel 160 (FIG. 14) defined by a specially configured extruded sleeve 161. Channel 160 is defined by a pair of opposing side walls 162 and a web 163 extending between the side walls 162. Each of the side walls 162 includes a horizontally extending groove 164 which is adapted to receive roll-in bead and stationary beads 154 and 155. Beads 154 and 155 hold glass pane 145 upright within channel 160. Extending upwardly from web 163, in-line with side walls 162 are arms 165 for attaching expressway channels 32, such as with fasteners 166. An expressway glass cap 167 is mounted on top of expressway channels 32. Expressway glass cap 167 includes a pair of downwardly projecting arms 168 for attaching cap 167 to expressway channels 32, such as with fasteners 166. Cap 167 also includes upwardly extending connector hooks 169 which are engaged by connector hooks 170 on downwardly projecting flanges 171 and 172 of glass stops 173. Glass stops 173 include grooves 174 which receive beads 175 and 176 which hold transom glass 177 in an upright position within a channel 178 defined by cap 167 and the flanges 171 of glass stops 173. Disposed within the channel 178 is a support bead 179. Support bead 179 is positioned between the bottom edge of transom glass 177 and the bottom of channel 178. Bead 179 is preferably an extruded elastomeric material capable of supporting transom glass 177 without abrading the bottom edge thereof.

Figure 15:
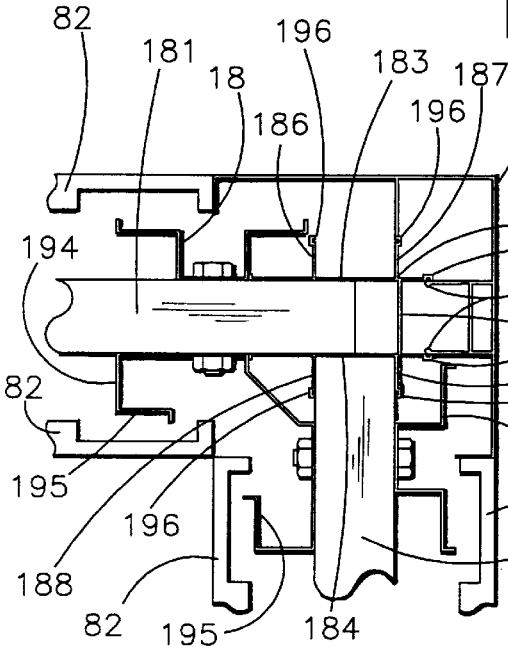
FIG. 15 is a fragmentary, horizontal cross sectional view of a 90° corner between two perpendicular solid-core walls.
Figure 16:
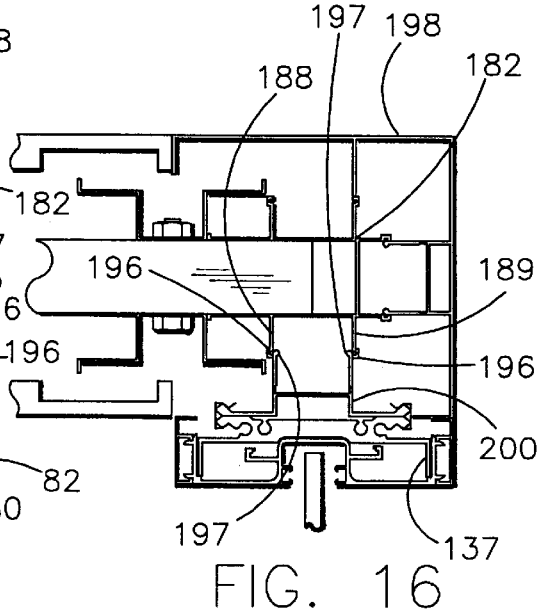
FIG. 16 is a fragmentary, horizontal cross sectional view of a 90° corner between a solid-core wall and a perpendicular glass wall.
Figure 21:
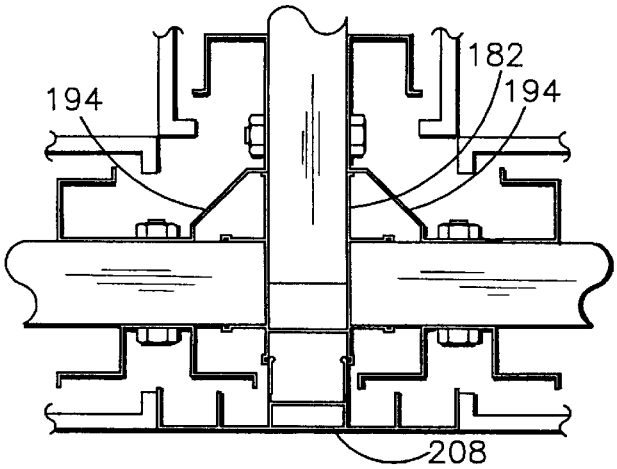
FIG. 21 is a fragmentary, horizontal cross sectional view of an alternative three-way connection between aligned solid-core walls and a solid-core wall which is perpendicular to the aligned solid-core walls.
Figure 22:
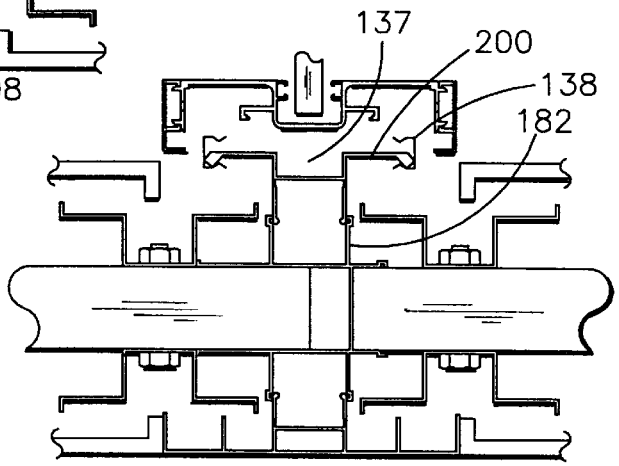
FIG. 22 is a fragmentary, horizontal cross sectional view of a three-way connection between aligned solid-core walls and a glass wall which is perpendicular to the aligned solid-core walls.
Figure 29:
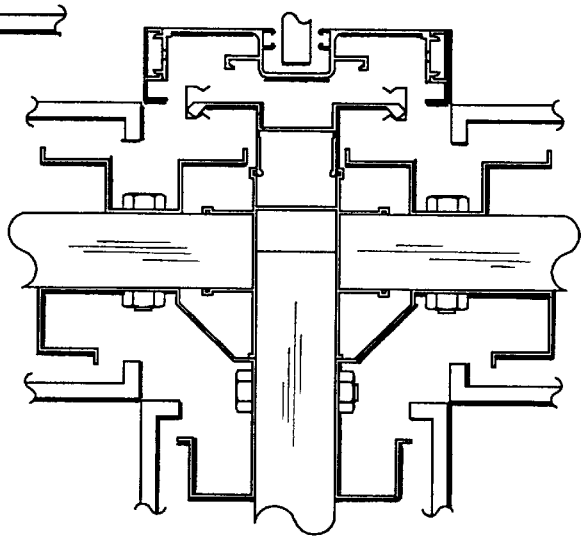
FIG. 29 is a fragmentary, horizontal cross sectional view of a four-way connection between two aligned solid-core walls, a solid-core wall which is perpendicular to the aligned solid-core walls, and a glass wall which is perpendicular to the aligned solid-core walls and which is aligned with the solid-core wall which is perpendicular to the aligned solid-core walls.

FIG. 15 illustrates a 90° corner connection between perpendicular core walls. The intersecting core walls 180 and 181 are joined by a core cap corner extrusion 182 having uniformly spaced apart walls 183 and 184 connected by web 185. Projecting from the side of wall 183 which is opposite to the side facing wall 184 are a pair of uniformly spaced apart walls 186 and 187. Likewise, projecting from the side of wall 184 which is opposite to the side facing wall 183 are a pair of uniformly spaced apart walls 188 and 189. Web 185 together with walls 182, 183, 186, 187, 188 and 189 define channels 190, 191, 192 and 193. Each of the channels 190–193 is sized and configured to receive the vertical end of a core wall, such as 180 or 181. Channels 190 and 192 are in alignment, as are channels 191 and 193. Channels 190 and 192 are substantially perpendicular to channels 191 and 193. Accordingly, core cap cover extrusion 182 can be utilized for connecting two perpendicular core walls at an intersecting corner as shown in FIG. 15, or for connecting two in-line core walls with a core wall which is perpendicular to the in-line core walls, as shown in FIGS. 21 and 22, or for connecting four intersecting core walls as shown in FIG. 29. The ends of core walls 180 and 181 are reinforced with vertical studs 18 and with a corner stud 194. Corner stud 194 is generally similar to vertical studs 18, except corner studs 194 have the transverse cross sectional shape or profile shown in FIG. 15. Skins or cover panels 82 are attached to flanges 30 of studs 18 as previously described, and to flanges 195 of corner stud 194, in a manner analogous to the manner in which they are attached to vertical studs 18. The ends of walls 182, 183, 186, 187, 188 and 189 include connector hooks 196 which can engage connector hooks on various trim pieces and connectors. The connector hooks 196 facilitates snap attachment of trim pieces and connectors to the core cap cover extrusion 182. The connector hooks 196 at the end of walls 183 and 184 are engaged by connectors 197 on corner trim cover extrusion 198. A 90° two-way corner between a solid-core wall and a glass wall is shown in FIG. 16. As with the solid-core wall to solid-core wall corner, the solid-core wall to glass wall corner utilizes a core cap cover extrusion 182 and corner trim cover extrusion 198. However, walls 188 and 189 are connected to a core wall to glass wall connector extrusion 200 having connector hooks 197 which engage connector hooks 196 at the end of walls 188 and 189. The remaining components used for connecting extrusion 200 to a glass panel 202 are substantially identical to those used for connecting the core wall and glass panel shown in FIG. 11.

Figure 18:
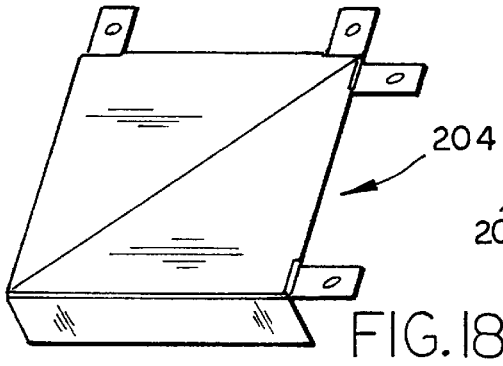
FIG. 18 is a top perspective view of the comer cover cap shown in FIG. 18.
Figure 17:
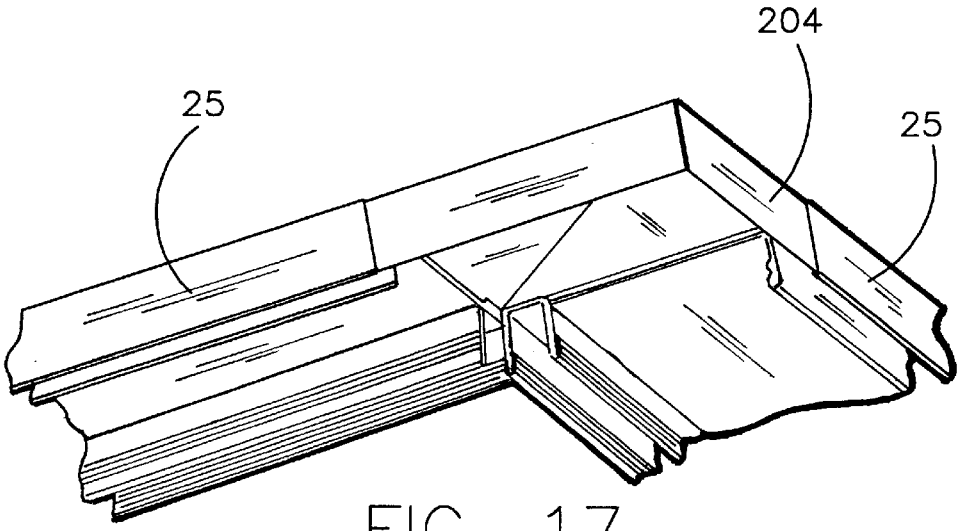
FIG. 17 is a bottom perspective view of a comer cover cap and ceiling tracks for walls which intersect at a 90° corner.

In order to fill the upper edges at the corners between the ceiling and the top edge of the corner trim cover extrusion 198 a cover corner cap 204 (FIGS. 17 and 18) is connected to the ceiling or ceiling grid at the intersection between ceiling tracks 25. As shown in FIG. 18, the corner cap includes a plurality of fastener tabs which project outwardly from edges of the corner cap to facilitate attachment of the cover corner cap 204 to the ceiling or ceiling grid using fasteners such as screws.

Figure 19:
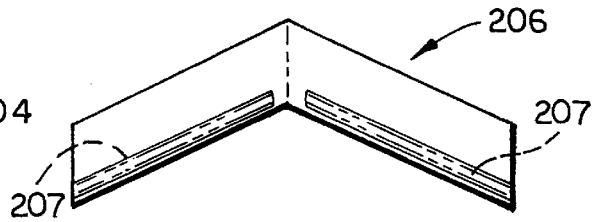
FIG. 19 is a perspective view of a 90° corner base molding.

In order to provide a neat corner at the intersection between two intersecting core walls, a corner base molding 206 (FIG. 19) is provided. Cover base molding 206 includes integral clips 207 which hook onto the upwardly extending walls 81 of floor track 27 in a manner generally analogous to the way that base trim moldings 116 are clipped to walls 81 of floor track 27.

Figure 20:
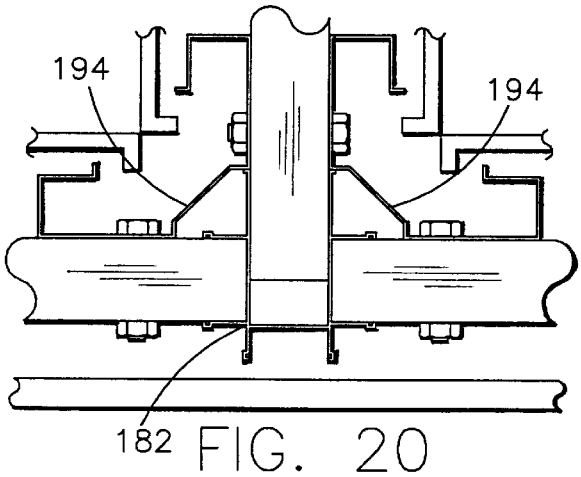
FIG. 20 is a fragmentary, horizontal cross sectional view of a three-way connection between two aligned solid-core walls and a solid-core wall which is perpendicular to the aligned solid-core walls.
Figure 23:
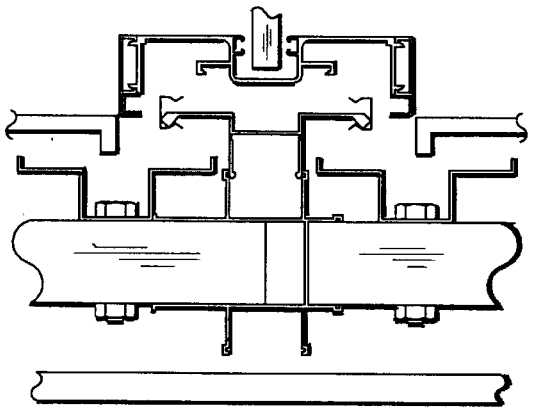
FIG. 23 is a fragmentary, horizontal cross sectional view of an alternative three-way connection between aligned solid-core walls and a glass wall which is perpendicular to the aligned solid-core walls.

FIG. 20 shows a three-way connection between solid-core walls using various components which have been previously described, including core cap cover extrusion 182 and corner studs 194. An alternative three-way connection between solid-core walls is shown in FIG. 21 which employs a core cap corner extrusion 182, corner studs 194 and an extruded end cap 208 having projecting arms with connector hooks 197 which engage connector hooks 196 on core cap corner extrusion 182. FIGS. 22 and 23 show alternative three-way connections between two in-line solid-core walls and a glass wall which is perpendicular to the solid-core walls using various components which have been previously described including core cap corner extrusion 182, core wall to glass wall connector 200, connector extrusion 137, and spring clips 138.

Figure 24:
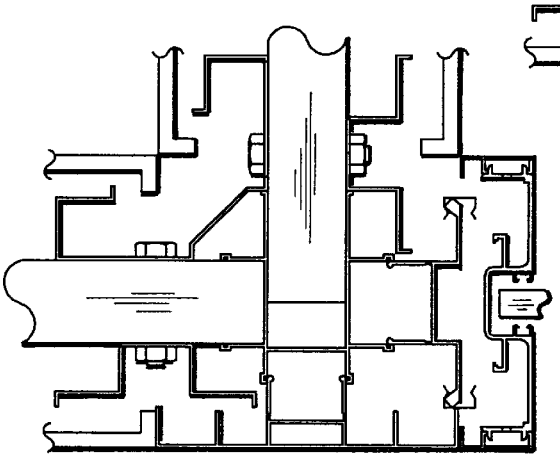
FIG. 24 is a fragmentary, horizontal cross sectional view of a three-way connection between a solid-core wall which is aligned with a glass wall and a solid-core wall which is perpendicular to the aligned walls.
Figure 26:
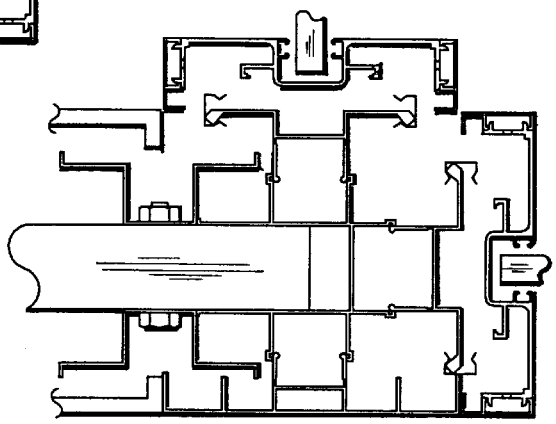
FIG. 26 is a fragmentary, horizontal cross sectional view of a three-way connection between a solid-core wall and two glass walls, one of which is aligned with the solid-core wall, the other which is perpendicular to the solid-core wall.
Figure 25:
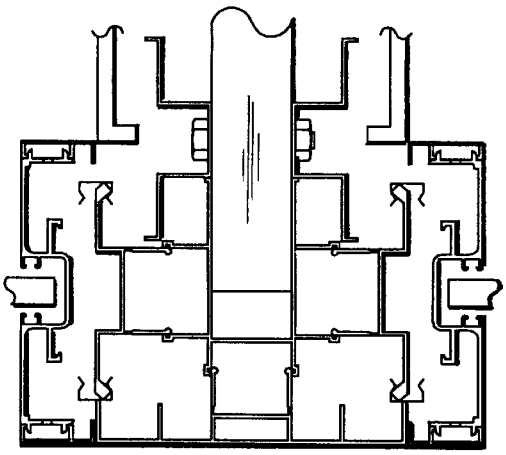
FIG. 25 is a fragmentary, horizontal cross sectional view of a three-way connection between aligned glass walls and a solid-core wall which is perpendicular to the aligned glass walls.
Figure 27:
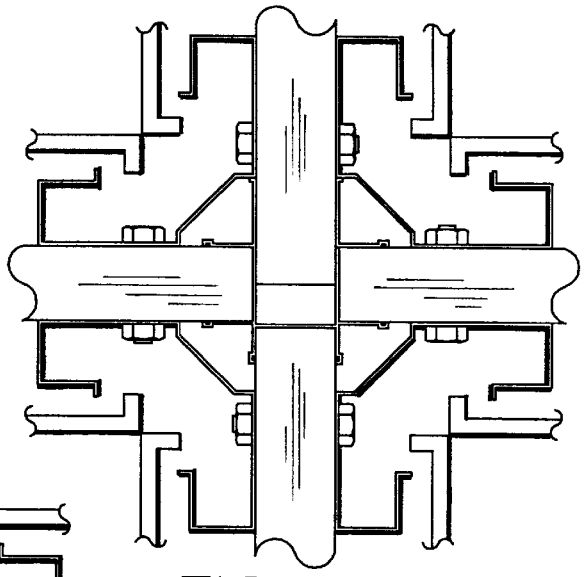
FIG. 27 is a fragmentary, horizontal cross sectional view of a four-way connection between a first pair of aligned solid-core walls and a second pair of aligned solid-core walls which is perpendicular to the first aligned solid-core walls.
Figure 28:
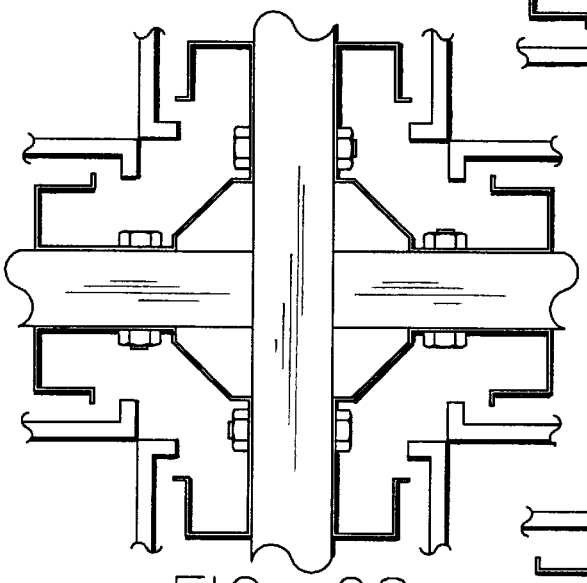
FIG. 28 is a fragmentary, horizontal cross sectional view of an alternative four-way connection between intersecting solid-core walls.

FIGS. 24, 25 and 26 show various other three-way connections between at least one solid-core wall and at least one glass wall using the various components which have been previously described. FIGS. 27 ad 28 show alternative four-way connections between solid-core walls using the components which have been previously described. FIG. 29 shows a four-way connection between three solid-core walls and a glass wall using components which have been previously described.

The solid-core wall is constructed by installing the ceiling and floor track in a conventional manner so that they are vertically aligned on center. Next, the ceiling track core capture extrusions 24 are snapped onto the ceiling track. The ceiling track core capture extrusions 24 are approximately 6 inches long and can be place approximately every 12 inches along a run of ceiling track. Thereafter, the core panels 12 are installed. The core consist of two layers of core panels, with each layer comprising a plurality of solid-core panels 12 arranged in edge-to-edge abutment. The abutting edges or joints in each layer are laterally offset from the joints in the adjacent layer to cover and eliminate gaps in the wall which could allow light and sound to penetrate or leak through the wall. The vertical studs 18 are then mounted on either side of the core wall directly across from each other and fastened together through the core with flanged bolts 20 and nuts 22. The studs are placed approximately 24 inches apart along the wall. Next, the expressway channel is attached to the wall. The studs, and, optionally, the expressway channel 32 are cut out or notched so that the expressway channel and vertical studs intersect in the same vertical plane adjacent to the core. The expressway channel is attached to the core wall comprising panels 12 with fasteners such as dry wall screws. The wall is finished by attaching the wall cover panels or skins 82 to the vertical studs 18 as described above, and by attaching the expressway channel covers 52 and base trim moldings 116.

The wall system allows vertical adjustment of the studs with respect to the core wall to compensate for misalignment of adjacent wall covering panels 82. To adjust the height of the vertical studs 18, the skins are removed, the center bolt extending through circular aperture 34 is removed and the remaining bolts 20 are loosened. The studs 18 are then moved upwardly or downwardly as needed to achieve the desired adjustment and the bolts extending through the elongate apertures 36 are tightened. A new hole is drilled through the core and the center bolt is inserted through the circular aperture 34, reinstalled and tightened. Thereafter, the wall covering panels 82 are rehung. Notably, adjustment of the vertical studs can be achieved independently on each side by simply moving the studs on one side only.

The solid-core wall system is capable of off-module connection with a zone wall, and horizontal rails can be mounted to the core to allow attachment of binder binds or other furnishings or attachments through a reveal between vertically adjacent wall covering panels 82.

The solid-core wall system is capable of achieving excellent acoustic and fire resistance levels because of the solid-core panels 12. The wall has achieved STC values in testing ranging from 30 to 44. Using standard half inch thick partition panels 12, a one inch thick gypsum core can almost achieve a one hour fire rating. It is believed that if a different material, such as gypsum is used as the substrate material for the wall covering panels that a one hour rating is achievable.

The solid-core wall system is capable of being interface with glass walls, door jams, and the like. A glass transom can be provided on the solid-core wall system if desired.

The solid-core wall system of this invention is demountable and reconfigurable, and provides improved acoustic and fire resistance properties. The wall system of this invention also facilitates utility distribution through an expressway channel which is generally disposed within the plane between the solid-core and the wall covering panels. The wall system of this invention has the advantage of utilizing, as a main component, a commodity item, i.e., the solid-core panels, which can be purchased locally and which can be utilized without any substantial modifications.

It will be apparent to those skilled in the art that various modifications to the preferred embodiment of the invention as described herein can be made without departing from the spirit or scope of the invention as defined by the appended claims.

The embodiments of the invention in which an exclusive property or privilege is claimed are defined as follows:

1. A reconfigurable wall system comprising:

a structural solid-core wall including a plurality of solid-core panels arranged in two adjacent abutting layers, each layer comprising a plurality of said solid-core panels arranged in edge-to-edge abutment, the abutting edges of the panels forming vertical seams, the vertical seams in each of the layers being laterally offset from the seams in the adjacent layer;

a plurality of reinforcing vertical studs on opposite faces of the solid-core wall, each of the reinforcing vertical studs being aligned with another of said vertical studs on an opposing face of the solid-core wall and stiffening the structural solid-core wall, but terminating short of a lower edge of the solid-core panels, such that the solid-core panels support a weight of the wall system; and a plurality of horizontally spaced apart fasteners which extend through the solid-core wall and which connect aligned pairs of the reinforcing vertical studs on opposite sides of the solid-core wall.

2. The reconfigurable wall system of claim 1, wherein the vertical studs include a base portion abutting the solid-core wall, web portions which extend from opposite sides of the base away from the solid-core wall, and laterally spaced apart flanged portions which extend from the webs and are disposed in a vertical plane spaced from the solid-core wall; and wall covering panels attached to the flange portion of the vertical studs.

3. The reconfigurable wall system of claim 2, wherein a section of the web portions and flange portions of the vertical studs are cut out to form a notch, and wherein the reconfigurable wall system further comprises a horizontally extending expressway channel mounted to the solid-core wall and extending through the notches in the vertical studs, whereby the expressway channel provides means for distributing power and communication cables through the wall system.

4. The reconfigurable wall system of claim 3 further comprising a glass transom extending from the top of the expressway channel.

5. The reconfigurable wall system defined in claim 2 wherein the reinforcing vertical studs include apertures, and wherein the wall covering panels include connectors arranged to frictionally engage the apertures with the wall covering panels spanning between horizontally adjacent ones of the reinforcing vertical studs.

6. The reconfigurable wall system defined in claim 5 wherein the connectors include interlocking clips that releasably but lockingly engage the apertures.

7. The reconfigurable wall system of claim 1 further comprising a floor track defining a channel in which the bottom edge of the solid-core wall is received.

8. The reconfigurable wall system of claim 1 further comprising a ceiling track and a core capture extrusion which is attached to the ceiling track and which includes a channel in which the upper edge of the solid-core wall is received.

9. The reconfigurable wall system of claim 1 further comprising a floor track defining a channel in which the lower edge of the solid-core wall is received; a ceiling track; a core capture extrusion connected to the ceiling track and including a channel in which the upper edge of the solid-core wall is received; and a plurality of wall covering panels attached to the vertical studs.

10. The reconfigurable wall system of claim 9, wherein the vertical studs include a base portion abutting the solid wall, web portions which extend from opposite sides of the base portion away from the solid wall, and laterally spaced apart flange portions which extend from the web portions and are disposed in a vertical plane spaced from the solid wall, a section of the web portions and flange portions of the vertical studs being cut out to form a notch; and further comprising a horizontally extending expressway channel mounted to the solid wall and extending through the notches in the vertical studs, whereby the expressway channel provides means for distributing power and communication cables through the wall system.

11. The reconfigurable wall system of claim 10 wherein the expressway channel includes a center septum which divides the expressway channel into an upper channel and a lower channel, whereby power and communication cables are able to be distributed through separated channels.

12. The reconfigurable wall system defined in claim 1 wherein the reinforcing vertical studs include vertically extending slots, and wherein the fasteners extend through the slots.

13. The reconfigurable wall system defined in claim 1 wherein the solid-core panels include gypsum material.

14. A reconfigurable wall system comprising:

a load-bearing solid-core wall including a plurality of solid-core wall panels having opposing faces and laterally spaced apart edges, the solid-core wall panels being arranged in abutting wall layers with a face of each said solid-core wall panel in one of the wall layers abutting a face of adjacent ones of said solid-core wall panels in an adjacent wall layer, an edge of each said solid-core wall panel in each of the wall layers abutting an edge of an adjacent one of said solid-core wall panels in the same wall layer to form edge seams, the edge seams in each of said one wall layers being laterally spaced from the edge seams in the adjacent wall layer, whereby said solid-core wall panels in each said wall layer overlap the edge seams in the adjacent wall layer to create a stronger wall;

a plurality of vertically adjustable, reinforcing vertical studs disposed on opposite faces of the solid-core wall, each of the vertical studs being aligned with a vertical stud on the opposite side of the solid-core wall and having vertical slots therein;

a plurality of fasteners which extend through the solid-core wall and through the vertical slots to adjustably connect the aligned vertical studs on opposite sides of the solid-core wall; and a plurality of wall covering panels mounted on the vertical studs.

15. The reconfigurable wall system of claim 14 wherein a section of the web portions and flange portions of the vertical studs are cut out to form a notch, and wherein the reconfigurable wall system further comprises a horizontally extending expressway channel mounted to the solid-core wall and extending through the notches in the vertical studs, whereby the expressway channel provides means for distributing power and communication cables through the wall system.

16. The reconfigurable wall system of claim 14 further comprising a floor track defining a channel in which the bottom edge of the solid-core wall is received.

17. The reconfigurable wall system of claim 14 further comprising a ceiling track and a core capture extrusion which is attached to the ceiling track and which includes a channel in which the upper edge of the solid-core wall is received.

18. The reconfigurable wall system of claim 14 further comprising a floor track defining a horizontal channel in which the lower edge of the solid-core wall is received; a ceiling track; a core capture extrusion defining a channel in which the upper edge of the solid-core wall is received; and wherein the vertical studs include a base portion abutting the core wall, web portions which extend from opposite sides of the base away from the core wall, and laterally spaced apart flange portion which extend from the web portions and are disposed in a vertical plane spaced from the core wall, a section of the web portions and flange portions of the vertical studs being cut out to form a notch; and wherein the reconfigurable wall system further comprises a horizontally extending expressway channel mounted to the core wall and extending through the notches in the vertical studs, whereby the expressway channel provides means for distributing power and communication cables through the wall system.

19. The reconfigurable wall system of claim 14 further comprising a glass transom extending from the top of the expressway channel.

20. The reconfigurable wall system defined in claim 14 wherein the reinforcing vertical studs include vertically extending slots, and wherein the fasteners extend through the slots.

21. The reconfigurable wall system defined in claim 14 wherein the reinforcing vertical studs include apertures, and wherein the wall covering panels include connectors arranged in a pattern to frictionally engage the apertures with the wall covering panels spanning between horizontally adjacent ones of the reinforcing vertical studs.

22. The reconfigurable wall system defined in claim 21 wherein the connectors include interlocking clips that releasably but lockingly engage the apertures.

23. The reconfigurable wall system defined in claim 14 wherein the solid-core panels include gypsum material.

24. A reconfigurable wall system comprising:

a load-bearing solid-core wall including a plurality of solid-core panels, the panels being arranged in two adjacently abutting vertical layers, each layer comprising a plurality of said solid-core panels arranged in edge-to-edge abutment, the abutting edges forming vertical seams, the vertical seams in each layer being laterally offset from the vertical seams in the adjacent layer;

a plurality of vertically adjustable, reinforcing vertical studs disposed on opposite faces of the solid-core wall, each of the vertical studs being aligned with a vertical stud on the opposite side of the solid-core wall;

a plurality of horizontally spaced apart fasteners which extend through the solid-core wall and connect the aligned vertical studs on opposite sides of the solid-core wall, the vertical studs and the fasteners being constructed to permit vertical adjustment of the vertical studs;

a plurality of wall covering panels removably mounted with frictional connectors on the vertical studs;

a core cap extrusion secured to an end of the solid-core wall; and a glass wall portion connected in-line with the solid-core wall, the glass wall portion comprising a glass wall base and a glass wall panel supported on the glass wall base, and a glass jam connected to a side edge of the glass wall panel, the glass wall being connected in-line to the solid-core wall by an in-line connector extrusion attached to the core cap extrusion and to the glass jam, the core cap extrusion and the in-line connector extrusion having abutting tabs which are secured together by a resilient clip.

25. A reconfigurable wall system comprising:

a load-bearing solid-core wall comprising a double layer of gypsum panels, each having a bottom edge;

pairs of reinforcing studs located on opposite sides of the solid-core wall and fasteners connecting each of the pair of reinforcing studs together against the gypsum panels so that the reinforcing studs stiffen and support the gypsum panels, thus giving the gypsum panels sufficient stability to bear a weight of the wall system, the reinforcing studs being vertically adjustable on the fasteners and including a bottom end spaced above the bottom edge of the gypsum panels, the reinforcing studs having apertures; and cover panels covering the solid-core wall, the cover panels having connectors releasably frictionally engaging the apertures in the reinforcing studs.

26. A reconfigurable wall system comprising:

a load-bearing solid-core wall;

pairs of reinforcing studs located on opposite sides of the solid-core wall;

fasteners securing the pairs of reinforcing studs together;

the reinforcing studs each having a first flange engaging a face of the solid-core wall, a second flange extending from the first flange away from the face, a third flange extending from the second flange that is parallel but not coplanar with the first flange, and notches that extend through the third flange and at least partially into the second flange; and a horizontally extending channel closely engaging the notches of the reinforcing studs and defining a horizontal raceway across the wall system.

* * * * *

UNITED STATES PATENT AND TRADEMARK OFFICE

CERTIFICATE OF CORRECTION

PATENT NO. : 5,822,935

DATED :October 20,1998

INVENTOR(S) : Terry Mitchell et al.

It is certified that error appears in the above-identified patent and that said Letters Patent is hereby corrected as shown below:

Column 1, Line 49;
"the" should be --they--

Column 2, lines 7 and 9;
"Glockstiein" should be --Glockenstein--.

Column 4, lines 8 and 10;
"comer" should be --corner--.

Column 4, line 11;
"FIG. 18" should be --FIG. 17--.

Column 5, line 18;
"vertically" should be --vertical--.

Column 6, line 26;
"cold roll steel" should be --cold rolled steel--.

Column 6, line 39;
"rib 62" should be --ribs 62--.

Column 7, lines 11 and 13;
"extrusion" should be --extrusions.

UNITED STATES PATENT AND TRADEMARK OFFICE

CERTIFICATE OF CORRECTION

PATENT NO. : 5,822,935

DATED : October 20,1998

INVENTOR(S) : Terry Mitchell et al.

It is certified that error appears in the above-identified patent and that said Letters Patent is hereby corrected as shown below:

Column 7, line 50;
"a aperture" should be --an aperture--.

Column 8, line 14;
"panels 82 is" should be --panels 82 are".

Column 8, line 47;
"opening or channels" should be --openings or channels--.

Column 10, line 15;
"and extruded" should be --an extruded--.

Column 11, lines 30-31;
"facilitates" should be --facilitate--.

Column 12, line 13;
--27 ad 28" should be --27 and 28--.

Column12, line 24;
"place" should be --placed--.

UNITED STATES PATENT AND TRADEMARK OFFICE

CERTIFICATE OF CORRECTION

PATENT NO. : 5,822,935
DATED : October 20,1998
INVENTOR(S) : Terry Mitchell et al.

It is certified that error appears in the above-identified patent and that said Letters Patent is hereby corrected as shown below:

Column 12, line 26;
"consist" should be --consists--.

Column 12, line 37;
"channel 32" should be --channels 32--.

Column 13, line 7;
"interface" should be --interfaced--.

Column 13, line 12;
"fire resistance properties" should be --fire resistant properties--.

Column 14, Claim 10, lines 26-27, 28, 31 & 34;
"solid wall" should --solid-core wall--.

Signed and Sealed this

First Day of June, 1999

*Attest:*

*Attesting Officer*

Q. TODD DICKINSON

*Acting Commissioner of Patents and Trademarks*